United States Patent [19]

Zeller et al.

[11] 4,347,087

[45] Aug. 31, 1982

[54] GRANULAR PROPELLANT POWDER BASED ON NITROCELLULOSE, OILY NITRATE ESTER AND POLYVINYL NITRATE, AND PROCESS

[75] Inventors: Bernard M. Zeller, Brunoy; René J. Couturier, Mennecy; Robert A. Tribot, Hiersac, all of France

[73] Assignee: Societe Nationale des Poudres et Explosifs, Paris, France

[21] Appl. No.: 100,646

[22] Filed: Dec. 5, 1979

[30] Foreign Application Priority Data

Dec. 22, 1978 [FR] France ..... 78 36103

[51] Int. Cl.[3] ..... C06B 25/26

[52] U.S. Cl. ..... 149/98; 149/19.8; 149/96; 149/100; 149/109.6

[58] Field of Search ..... 149/19.91, 19.8, 19.92, 149/96, 98, 100, 109.6

[56] References Cited

U.S. PATENT DOCUMENTS

| | | | |
|---|---|---|---|
| 3,669,924 | 6/1972 | Daume | 149/19.91 |
| 4,023,996 | 5/1977 | Leneveu | 149/19.8 |

FOREIGN PATENT DOCUMENTS

| | | | |
|---|---|---|---|
| 2968 | 7/1979 | European Pat. Off. | 149/19.91 |
| 2329558 | 1/1975 | Fed. Rep. of Germany | 149/19.8 |
| 2556121 | 6/1976 | Fed. Rep. of Germany | 149/19.91 |
| 1190001 | 4/1970 | United Kingdom | 149/19.91 |
| 1419858 | 12/1975 | United Kingdom . | |

*Primary Examiner*—Edward A. Miller
*Attorney, Agent, or Firm*—Bucknam and Archer

[57] ABSTRACT

The present invention relates to propellant powders based on nitrocellulose, nitrated oil and polyvinyl nitrate and also to the process for their manufacture.

The powders according to the invention contain between 50 and 75 parts by weight of nitrocellulose, between 5 and 25 parts by weight of nitrated oil and between 5 and 25 parts by weight of polyvinyl nitrate.

The manufacturing process consists in malaxating the energy-producing bases in the presence of an acetone-/alcohol mixture until a homogeneous paste is obtained, which is extruded, drained, chopped, soaked and dried, and the process is characterized in that (i) the proportion of acetone in the paste during malaxation is between 30 and 36% by weight, relative to the dry nitrocellulose and the dry polyvinyl nitrate, and in that the weight ratio acetone/alcohol is between 1.10 and 1.50, (ii) the first step is to mix the nitrocellulose with the nitrated oil in the presence of solvents, and in that the solid polyvinyl nitrate is added to the mixture in portions, and (iii) the draining before chopping is carried out at a temperature below 30° C.

The powders according to the invention are particularly suitable as gunpowder for combat tanks.

7 Claims, No Drawings

GRANULAR PROPELLANT POWDER BASED ON NITROCELLULOSE, OILY NITRATE ESTER AND POLYVINYL NITRATE, AND PROCESS

The terms "nitrated oil" and "explosive nitrated oil" designate energetic plasticizers which are oily nitrate esters.

The present invention relates to the field of granular homogeneous propellant powders for weapons, and more especially to the field of gunpowders for combat tanks. The invention relates to propellant powders based on nitrocellulose, nitrated oil and polyvinyl nitrate and also to the process for their manufacture.

The base material for the manufacture of present-day propellant powders is nitrocellulose, which, when gelatinised by a suitable solvent, such as a mixture of ethyl ether and ethyl alcohol, and mixed with the customary additives known to those skilled in the art, such as stabilisers and combustion moderators, produces powders which are commonly designated by the general name "smokeless powders". These powders are very suitable for most conventional weapons. They are described, for example, in the work "Les Poudres et Explosifs" ("Powders and Explosives") by L. VENNIN, E. BURLOT and H. LECORCHE, Librairie Polytechnique ch. BERANGER, page 578 et seq., (1932). On the other hand, they are not sufficiently "powerful" to be used advantageously in guns for combat tanks. This must be understood as meaning that the energy developed in the breech of the weapon by the combustion gases from the powder is not sufficient to give the desired momentum to the projectile. In fact, in the particular case of guns for combat tanks, the lifetime of the barrel is an accepted sacrifice which is made in order to obtain the maximum performances in terms of the ejection speed of the projectile, and it is necessary to use the most powerful powders possible.

Attempts have been made to increase the power of propellant powders based on nitrocellulose by incorporating an explosive nitrated oil, such as nitroglycerine, therein. This type of powder is described, for example, in French Pat. Nos. 1,311,647, 1,456,283 and 2,153,039. These powders, which are generally referred to as two-component powders, possess the power required for use in tank guns and mortars, but they exhibit two major disadvantages. Firstly, in large amounts, nitroglycerine tends to migrate towards the outside of the grain of powder and to form droplets at the periphery of the grain, this phenomenon, which is also referred to as exudation, giving rise to a variation in the ballistic properties of the powder with time, not to mention the danger caused by the presence of free nitroglycerine on the surface of the grains of powder. Secondly, these powders have a very high combustion temperature and thus erode the weapon too rapidly by excessive heating of the internal surface of the gun barrel.

In order to obtain propellant powders which are powerful but have a lower combustion temperature, heterogeneous powders based on nitrocellulose and nitroglycerine and on a charge, such as nitroguanidine, have been proposed. These powders are said to be heterogeneous and not homogeneous because, when they are viewed in section through a microscope, it is observed that the charge does not blend with the other propellant bases, but retains its own identity. In fact, these powders possess advantageous power and have a lower combustion temperature than that of the above-mentioned two-component powders, but they have a mediocre mechanical strength, especially in the cold, which is due in particular to their heterogeneity. Such powders are described, for example, in French Pat. No. 2,295,932.

It has also been proposed to use other bases for propellant powders, in particular polyvinyl nitrate, described in French Pat. No. 911,759. However, polyvinyl nitrate cannot be used by itself because its mechanical strength is inadequate. Mixed with nitrocellulose, polyvinyl nitrate makes it possible to obtain good propellant powders. Such powders are described, for example, in French Pat. No. 2,210,589. However, these powders are not sufficiently powerful to be able to be used advantageously in tank guns; furthermore, efforts to add an explosive nitrated oil to this type of powder have never been successful hitherto, and attempts to mix the three constituents nitrocellulose, polyvinyl nitrate and explosive oil have hitherto led to a nonhomogeneous paste which it is virtually impossible to extrude and chop into grains. For these reasons, no powders for tank guns, based on nitrocellulose, polyvinyl nitrate and nitrated oil, are known at the present time.

The present invention relates to a new granular homogeneous propellant powder, based on nitrocellulose, an explosive nitrated oil and polyvinyl nitrate, which possesses sufficient power to be able to be employed in tank guns, whilst at the same time not exhibiting the disadvantages of two-component powders and, in particular, being less erosive than the latter. The powders according to the invention are characterised in that they contain between 50 and 75 parts by weight of nitrocellulose, between 5 and 25 parts by weight of polyvinyl nitrate and between 5 and 25 parts by weight of a nitrated oil, per 100 parts by weight of energy-producing base.

The present invention also relates to a process for the production of the powders according to the invention. The process according to the invention consists in malaxating the energy-producing bases in the presence of an acetone/alcohol mixture until a homogeneous paste is obtained, which is extruded, drained, chopped, soaked and dried, and this process is characterised in that:

(i) the proportion of acetone in the paste during malaxation is between 30 and 36% by weight, relative to the weight of dry nitrocellulose and dry polyvinyl nitrate, and in that the weight ratio acetone/alcohol is between 1.10 and 1.50, (ii) the first step is to mix the nitrocellulose with the nitrated oil in the presence of the solvents, and the dry polyvinyl nitrate is then added to the nitrocellulose/nitrated oil/solvent mixture in portions, and (iii) the draining before chopping is carried out at a temperature below 30° C.

The powders according to the invention possess a power which is comparable to that developed, under the same firing conditions, by the conventional gunpowders based on nitrocellulose and nitroglycerine, but they have a lower combustion temperature than the latter and are therefore less erosive towards the weapons. The applicants have furthermore observed that the powders according to the invention exhibit a smaller tendency to exude than the conventional powders based on nitrocellulose and a nitrated oil, and that, surprisingly, their temperature coefficient is substantially smaller than that of the conventional gunpowders. The temperature coefficient is a measure of the variations in the ballistic properties of a powder (pressure in the chamber and speed of the projectile on leaving the weapon) as a function of the temperature; the smaller this coefficient, the less dependent are the ballistic properties of the powder on temperature.

As already mentioned in the state of the art, no means of obtaining a homogeneous paste from the three constituents nitrocellulose, polyvinyl nitrate and nitrated oil have been known hitherto. The applicants have found that, by scrupulously observing the operating conditions stated above, it is possible to obtain a homogeneous paste which can be extruded satisfactorily and which, after chopping and soaking, leads to grains of powder having a defined geometry and a good mechanical strength.

As already stated above, the grains of powder according to the invention contain between 50 and 75 parts of nitrocellulose, between 5 and 25 parts of nitrated oil and between 5 and 25 parts of polyvinyl nitrate, per 100 parts of energy-producing base. The Applicant Company has observed that homogeneous powder possessing the adequate ballistic and mechanical properties to be able to be employed as gunpowders is not obtained outside these composition limits. An oil chosen from the group comprising nitroglycerine, trimethylolmethane trinitrate and trimethylolethane trinitrate can be employed as the nitrated oil. According to a preferred embodiment of the invention, nitroglycerine is used.

In addition to the energy-producing bases, the powders according to the invention generally contain a stabiliser, such as 2-nitrodiphenylamine; they can also contain flash inhibitors, such as, for example, potassium cryolite. The powders according to the invention are not generally glazed but they can be graphitized, depending on the intended use. A preferred composition according to the invention contains 67 parts of nitrocellulose, 16.5 parts of nitroglycerine, 16.5 parts of polyvinyl nitrate and 1.5 parts of 2-nitrodiphenylamine. Another preferred composition contains 60 parts of nitrocellulose, 20 parts of nitroglycerine, 20 parts of polyvinyl nitrate and 1.5 parts of 2-nitrodiphenylamine.

The invention also relates to a process for the manufacture of the powders according to the invention. This process is a process using solvents, which consists in malaxating the energy-producing bases in the presence of the said solvents until a homogeneous paste is obtained, which is extruded in the form of strands which are drained and chopped into grains. The grains of powder are then soaked and dried. The production of a homogeneous paste from nitrocellulose, a nitrated oil and polyvinyl nitrate is very difficult.

The applicants have discovered that homogeneous pastes which can easily be extruded and chopped into grains can only be obtained by observing very particular conditions as regards the nature and the amounts of the solvents used and as regards the operating conditions for mixing.

According to the invention, the solvent used is a mixture of acetone and a lower aliphatic alcohol in a ratio such that the proportion of acetone in the paste during malaxation is between 30 and 36% by weight, relative to the weight of dry nitrocellulose and dry polyvinyl nitrate, and such that the weight ratio acetone/alcohol is between 1.10 and 1.50. The preferred lower aliphatic alcohol is ethyl alcohol. In order to obtain a homogeneous paste, malaxation must be carried out in the following manner. The chosen amount of nitrocellulose, which is generally impregnated with alcohol, and the chosen amount of nitrated oil, which is generally already dissolved in acetone, are introduced into the malaxator and the mixture is completed with acetone and alcohol to give the required proportions of solvents, as defined above. The stabiliser and also the additives, if appropriate, are then added and the malaxator is then rotated. As soon as the paste of nitrocellulose/nitrated oil has formed, dry polyvinyl nitrate is added in portions, the malaxator being rotated between each portion so that the polyvinyl nitrate is absorbed each time by the paste which has already formed. When the total amount of polyvinyl nitrate has thus been added, the malaxator is rotated for several hours to give a perfectly homogeneous paste. A period of about five hours is generally sufficient. The paste thus obtained is then extruded as strands. The strands are then drained before being chopped into grains. According to a preferred version of the invention, the draining is carried out at a temperature below 30° C. so as not to impair the mechanical properties of the strands. After draining, the strands are chopped into grains. After having been subjected, if appropriate, to a first hot drying process, the grains are soaked in water and dried in the conventional manner. The grains of powder are not generally glazed but they can be graphitized, depending on the intended use.

The invention thus makes it possible to provide grains of homogeneous powder, based on nitrocellulose, nitrated oil and polyvinyl nitrate, which can be used, in particular, in guns for combat tanks, these grains of powder having a power which is comparable to that developed, under the same conditions, by conventional grains of powder based on nitrocellulose and nitroglycerine. The grains of powder according to the invention furthermore exhibit the dual advantage of having a lower combustion temperature than these conventional grains of powder and of having a smaller temperature coefficient.

The invention will be understood more clearly with the aid of the following illustrative embodiments which are given without implying a limitation.

EXAMPLE 1

67 kg of nitrocellulose (nitrogen level 13.2%), impregnated with ethyl alcohol, 16.5 kg of nitroglycerine, dissolved in acetone, and 1.5 kg of 2-nitrodiphenylamine are introduced into a malaxator. Alcohol and acetone are added to give a total of 23.4 kg of alcohol and 28.4 kg of acetone in the malaxator. The malaxator is rotated and, when the nitrocellulose/nitroglycerine paste has formed, dry polyvinyl nitrate is added in approximately 2 kg portions, the malaxator being rotated between each addition until 16.5 kg of polyvinyl nitrate have been introduced. The malaxator is then rotated for five hours. After malaxation, the resulting paste is extruded under a pressure of 170 bars through a die with seven pins. The strands of powder thus obtained are drained at ambient temperature for 6 hours. After draining, the strands of powder are chopped into grains and soaked in water at 55° C. for 96 hours. The grains of powder are then dried. The grains of powder then possess the following dimensions:

length: 15.5 mm
diameter of the grain: 7.5 mm
diameter of the holes (7 holes in total): 0.82 mm
mean web: 1.29 mm These grains of powder were fired in a 120 mm smooth-bore gun. The projectile weighed 6.2 kg and the amount of powder employed weighed 7.850 kg. Firings were carried out at −40° C., at +15° C. and at +51° C. By way of comparison, single-component grains of powder, which were analogous to the above grains but consisted mainly of nitrocellulose having a nitrogen level of 13.2%, were fired under the same conditions.

The results of the firings are summarised in Table I below.

TABLE I

| Firing temperature | Nature of the powder | $P_{MAX}$ | $V_{40}$ |
|---|---|---|---|
| −40° C. | according to the invention | 3,624 bars | 1,591 m/second |
| | single-component | 3,591 bars | 1,533 m/second |
| +15° C. | according to the invention | 4,073 bars | 1,627 m/second |
| | single-component | 4,153 bars | 1,587 m/second |
| +51° C. | according to the invention | 4,526 bars | 1,640 m/second |
| | single-component | 5,136 bars | 1,641 m/second |

$P_{MAX}$ = maximum pressure in the combustion chamber
$V_{40}$ = speed of the projectile at 40 meters from the muzzle of the gun.

It is apparent from Table I that the powder according to the invention gives the projectile a speed which, depending on the temperature, is at least equal to, or greater than, that given by a conventional single-component powder, and that, between −40° C. and +51° C., the speed of the projectile only varies by 49 m/second with the powder according to the invention, whereas it varies by 88 m/second with a conventional powder. The same applies to the pressures developed in the chamber during the firing of the powder.

Furthermore, the combustion temperature of the powder according to the invention, calculated from the energy balance, is 3,600° K., whereas, in the case of a conventional two-component powder of the same power, it is about 3,780° K., whereupon the invention provides a powder which is sufficiently powerful to be able to be used advantageously in tank guns, whilst at the same time being at a lower temperature than the customary two-component powders used in this type of weapon.

EXAMPLE 2

The powder of Example 1 is taken and it is graphitized in a coating drum with 0.2% by weight of graphite. The powder thus obtained is fired at ambient temperature in a 120 mm smooth-bore gun. The projectile weighs 6.2 kg, and 8.2 kg of powder are employed. The speed of the projectile at 40 meters from the muzzle of the gun is 1,675.5 m/second and the maximum pressure developed in the combustion chamber is 4,068 bars.

EXAMPLE 3

50 kg of nitrocellulose (nitrogen level 13.2%), impregnated with ethyl alcohol, 25 kg of nitroglycerine, dissolved in acetone, and 1.5 kg of 2-nitrodiphenylamine are introduced into a malaxator. Alcohol and acetone are added to give a total of 22.5 kg of alcohol and 26.3 kg of acetone in the malaxator. The malaxator is rotated and, when the nitrocellulose/nitroglycerine paste has formed, dry polyvinyl nitrate is added in approximately 2 kg portions, the malaxator being rotated between each addition until a total of 25 kg of polyvinyl nitrate has been introduced. The procedure followed is then as described in Example 1 and this gives grains of powder possessing the following dimensions:

length: 18.94 mm
diameter of the grain: 8.44 mm
diameter of the holes (seven holes in total): 1.21 mm
mean web: 1.25 mm These grains of powder were fired in a 120 mm smooth-bore gun. The projectile weighed 6.2 kg and the amount of powder employed weighed 6.2 kg. Firing was carried out at 15° C. The speed of the shell at 40 meters from the muzzle of the gun was 1,538 m/second and the maximum pressure in the combustion chamber was 3,504 bars. By way of comparison, the same shell, fired with 6.5 kg of a single-component powder such as that used in Example 1, had a speed, at 40 meters from the muzzle of the gun, of 1,480 m/second and a maximum pressure in the chamber of 3,250 bars.

EXAMPLE 4

This example is intended to show the importance of observing the operating conditions in the manufacture of the powder, and more particularly the importance of observing the conditions pertaining to the amounts of solvents used.

The procedure followed is exactly as described in Example 1, the only difference being that a total of 18.1 kg of alcohol and 23.6 kg of acetone is used. The proportion of acetone in the paste during malaxation is therefore only 28%, relative to the weight of dry nitrocellulose and dry polyvinyl nitrate. In contrast, the weight ratio acetone/alcohol is 1.3 and is therefore correct.

It is observed that, after leaving the die, the strands swell by about 5 to 6% of their diameter. After soaking and drying, the resulting grains of powder are deformed and a very large scatter in the dimensions is observed, which renders any industrial use of these grains impossible.

We claim:

1. A granular homogeneous propellant powder having suitable power for use in tank guns, which consists essentially of 50–75 parts by weight of nitrocellulose, 5–25 parts by weight of polyvinyl nitrate and 5–25 parts by weight of an oily nitrate ester which is a member selected from the group consisting of nitroglycerine, trimethylolmethane trinitrate and trimethylolethane trinitrate, said nitrocellulose, said polyvinyl nitrate and said oily nitrate ester being the energy-producing bases in the total amount of 100 parts.

2. Granular homogeneous propellant powder according to claim 1 which further consists essentially of a stabilizer.

3. The propellant powder according to claim 1, which consists of 67 parts of nitrocellulose, 16.5 parts of nitroglycerine, 16.5 parts of polyvinyl nitrate and 1.5 parts of 2-nitrodiphenylamine.

4. The propellant powder according to claim 1, which consists of 60 parts of nitrocellulose, 20 parts of nitroglycerine, 20 parts of polyvinyl nitrate and 1.5 parts of 2-nitrodiphenylamine.

5. A process for the manufacture of a granular homogeneous propellant powder having suitable power for use in tank guns, which consists of:

(a) mixing nitrocellulose in the amount of 50–75 parts with an oily nitrate ester in the amount of 5–25 parts by weight in the presence of a solvent which is a mixture of acetone and a lower aliphatic alcohol until a homogeneous paste is obtained and malaxating, the proportion of acetone in the paste during malaxation being between 30 and 36% by weight, relative to the weight of dry nitrocellulose and dry polyvinyl nitrate, the weight ratio acetone-/alcohol is between 1.10 and 1.50, (b) then adding polyvinyl nitrate in the amount of 5–25 parts in portions to said nitrocellulose/oily nitrate ester/solvent mixture until a homogeneous paste is obtained, said nitrocellulose, said polyvinyl nitrate, said oily nitrate ester being the energy-producing bases in the total amount of 100 parts by weight, (c) extruding, (d) draining at a temperature below 30° C., (e) chopping, soaking and drying.

6. Process according to claim 5 wherein the said lower aliphatic alcohol is ethyl alcohol.

7. The granular homogeneous propellant powder having suitable power for use in tank guns prepared by:

(a) mixing nitrocellulose in the amount of 50–75 parts with an oily nitrate ester in the amount of 5–25 parts by weight in the presence of a solvent which is a mixture of acetone and a lower aliphatic alcohol until a homogeneous paste is obtained and malaxating, the proportion of acetone in the paste during malaxation being between 30 and 36% by weight, relative to the weight of dry nitrocellulose and dry polyvinyl nitrate, the weight ratio acetone-/alcohol is between 1.10 and 1.50, (b) then adding polyvinyl nitrate in the amount of 5–25 parts in portions to said nitrocellulose/oily nitrate ester/solvent mixture until a homogeneous paste is obtained, said nitrocellulose, said polyvinyl nitrate, said oily nitrate ester being the energy-producing bases in the total amount of 100 parts by weight, (c) extruding, (d) draining at a temperature below 30° C., (e) chopping, soaking, and drying.

* * * * *